US006119975A

United States Patent [19]

Lemaire

[11] Patent Number: 6,119,975

[45] Date of Patent: Sep. 19, 2000

[54] ROTATING SLEEVE FOR A SLEEVE WITH YARN FOR A WEAVING MACHINE

[75] Inventor: Thierry Lemaire, Marcq-en-Baroeul, France

[73] Assignee: N.V. Michael Van de Wiele, Kortrijk/Marke, Belgium

[21] Appl. No.: 09/024,118

[22] Filed: Feb. 17, 1998

[30] Foreign Application Priority Data

Feb. 17, 1997 [BE] Belgium ..... 09700142

[51] Int. Cl.[7] ..... B65H 75/24

[52] U.S. Cl. ..... 242/571.4

[58] Field of Search ..... 242/571.4, 571.5, 242/577.1

[56] References Cited

U.S. PATENT DOCUMENTS

| | | | |
|---|---|---|---|
| 2,644,650 | 7/1953 | Burke, Jr. | 242/571.5 |
| 2,805,829 | 9/1957 | Segui | 242/571.5 |
| 3,285,528 | 11/1966 | Beindorf | 242/571.5 |
| 3,356,309 | 12/1967 | Poteat | 242/571.4 |
| 3,430,892 | 3/1969 | Heumann | 242/571.4 X |
| 5,244,163 | 9/1993 | Matsuo et al. | 242/571.5 |
| 5,492,280 | 2/1996 | Corres . | |

FOREIGN PATENT DOCUMENTS

| | | | |
|---|---|---|---|
| 0595008 | 5/1994 | European Pat. Off. . | |
| 0742297 | 11/1996 | European Pat. Off. . | |
| 2572374 | 2/1986 | France . | |
| 306780 | 10/1916 | Germany | 242/571.4 |
| 379424 | 6/1964 | Switzerland . | |

*Primary Examiner*—Michael R. Mansen
*Attorney, Agent, or Firm*—James Creighton Wray; Meera P. Narasimhan

[57] ABSTRACT

Rotating sleeves having a body for receiving a yarn sleeve. The body has a side extension forming a flank piece. The flank piece is deformable such that a transverse dimension, for example, the greatest radial transverse dimension, of the body is reduced. The flank piece is generally plate-shaped with opposite edges forming the side edge of the body. Since the flank piece with the yarn sleeve is deformable, it reduces the transverse dimension of the body and thereby allows for yarn sleeves with small diameters to be slipped on easily.

17 Claims, 1 Drawing Sheet

ROTATING SLEEVE FOR A SLEEVE WITH YARN FOR A WEAVING MACHINE

BACKGROUND OF THE INVENTION

This invention relates to a rotating sleeve, comprising a body that is provided for sliding a yarn sleeve on to it.

It is generally known to wind the yarn for a weaving machine on to a cardboard or plastic sleeve (a yarn sleeve) made as an open cylinder, and to slide the thus formed bobbin or cross-wound spool on to a rotating sleeve.

A known rotating sleeve has a hollow cylindrical body, and is provided with a central bearing seat for being rotatingly disposed on the spindle of a holder, in order to make possible the rotation of a yarn sleeve slid over this rotating sleeve, and consequently the unwinding of the yarn wound on to this yarn sleeve. This bearing seat is so made that the rotating sleeve can rotate round the longitudinal axis of the cylindrical body.

These rotating sleeves are especially used with weaving machines which are provided for weaving a fabric with a varying yarn consumption for the individual warp threads. The warp threads are then drawn off the cross-wound spools or bobbins, which are slid over respective rotating sleeves on a weaving frame provided behind the weaving machine. Such a weaving frame with rotating sleeves has been described in the Belgian patent application no. 09500426.

The bobbins or cross-wound spools have to be manually slid by a bobbin loader on to the rotating sleeves of the weaving frame. Often a great number of bobbins or cross-wound spools have to be slid on. Weaving frames with approximately 10000 bobbins are certainly not exceptional.

It regularly occurs that the work of the bobbin loader is hindered because of the fact that the internal diameter of the yarn sleeves of a number of bobbins or cross-wound spools is too small. This can be the result of contraction of the yarn sleeve, caused by a too loosely wound-up yarn, or damage during their transport.

The sliding-on of these bobbins or cross-wound spools can because of this not occur easily and requires an additional physical effort of the bobbin loader. Usually the working rhythm of the bobbin loader is adversely affected by this.

An object of this invention is to provide a rotating sleeve, with which the above mentioned disadvantage is remedied.

Because of the fact that a great number of rotating sleeves are necessary it is very important that the cost price of a rotating sleeve is kept as low as possible. For this reason it is an additional object of this invention to provide a rotating sleeve, which can be manufactured with relatively low production costs.

SUMMARY OF THE INVENTION

The above mentioned objectives are achieved by providing a rotating sleeve according to this invention, comprising a body that is provided for sliding a yarn sleeve on to it, whose body comprises a sideways extending flank piece, which is deformable so that a transverse dimension of the body can be reduced.

On to such a rotating sleeve can be slid without any problem yarn sleeves with an internal transverse dimension which, for the known rotating sleeves, would be too small in comparison to an external transverse dimension of the body, in order to make possible a problem-free sliding-on. Because of the deforming of the flank piece the external transverse dimension of the body can indeed be reduced in accordance with the internal transverse dimension of the yarn sleeve.

The rotating sleeve according to this invention can have a simple form, so that its production can be effected at relatively low production costs. This rotating sleeve can also be manufactured out of relatively inexpensive raw materials. By manufacturing the rotating sleeve for example, according to a moulding process, out of an inexpensive synthetic material its cost price can be kept very low.

In a preferred embodiment the deformation of the flank piece results in the greatest radial transverse dimension of the rotating sleeve body being reduced. The greatest radial transverse dimension of the body is the dimension that has to be adjusted to the internal diameter of a cylindrical yarn sleeve in order to make possible a problem-free sliding-on. Such a rotating sleeve is consequently especially suitable for bobbins or cross-wound spools with cylindrical yarn sleeves.

The aforementioned flank piece preferably extends principally according to the longitudinal direction of the body.

If the aforementioned flank piece is plate-shaped, and has at least one edge which is an outer side edge of the body, the flank piece can be produced with a great flexibility.

With a very preferred embodiment of the rotating sleeve according to this invention the aforementioned flank piece is plate-shaped, while it comprises two opposite edges which are an outer side edge of the body, The flank piece can be deformed on both sides so that a reduction of the transverse dimension of the body is also made possible on both sides of the body. In comparison to a one-sided extending flank piece a double reduction of the transverse dimension can therefore be achieved. Yarn sleeves with greatly differing internal transverse dimensions can be slid on to such a rotating sleeve. These internal transverse dimensions may furthermore also be considerably staller than the corresponding external transverse dimensions of the body, determined by the aforementioned edges of the unbent flank pieces.

In a particularly preferred and extremely effective embodiment each body comprises plate-shaped flank pieces, which are provided opposite each other at a distance apart from each other and are connected to each other. Each flank piece preferably also has two opposite edges which are an outer side edge of the body, so that each flank piece can provide for a bilateral reduction of a transverse dimension.

If the body has an open structure, in contrast to the closed cylindrical structure of the known rotating sleeves, the rotating sleeve can take on sleeves which have dents resulting from damage incurred. These dents are then slid into the empty space of the open structure. The rotating sleeve can as a result of its open structure also be manufactured out of plastic (e.g. by injection moulding) in a simple mould. Through the open structure a lighter rotating sleeve is also furthermore obtained, for which less plastic is necessary. Moreover with the production of this rotating sleeve shorter cycle times are achieved than with the production of known rotating sleeves. All of this results in a considerable reduction of the raw material and production costs. Because of this the cost price of these rotating sleeves can be kept particularly low.

A preferred open structure of the body is obtained when the two plate-shaped flank pieces are connected to each other by at least one connecting piece, so that a cross-section of a connecting piece and the flank pieces is principally I-shaped.

In a greatly preferred embodiment of the rotating sleeve according to this invention the two plate-shaped flank pieces are connected to each other by at least two plate-shaped connecting pieces provided one behind the other according to the longitudinal direction of the body, while the rotating sleeve is provided for being slid on to a holder spindle approximately according to the longitudinal direction, and while a passage for this holder spindle is provided in each connecting piece. Because of this the rotating sleeve can easily be slid on to the holder spindle, and the successive passages in the connecting pieces form several bearing points for this holder spindle.

Preferably each plate-shaped flank piece comprises a flexible edge part on each edge which is an outer side edge of the body.

If each flank piece is furthermore elastically deformable, it will press against the inner wall of a yarn sleeve slid on to the body, so that this yarn sleeve will remain well held on the rotating sleeve.

This invention is further explained in the following non-restrictive description of an embodiment of a rotating sleeve according to the invention. In this description reference is made to the drawing attached hereto, in which

DETAILED DESCRIPTION OF THE PREFERED EMBODIMENT

Figure 1:
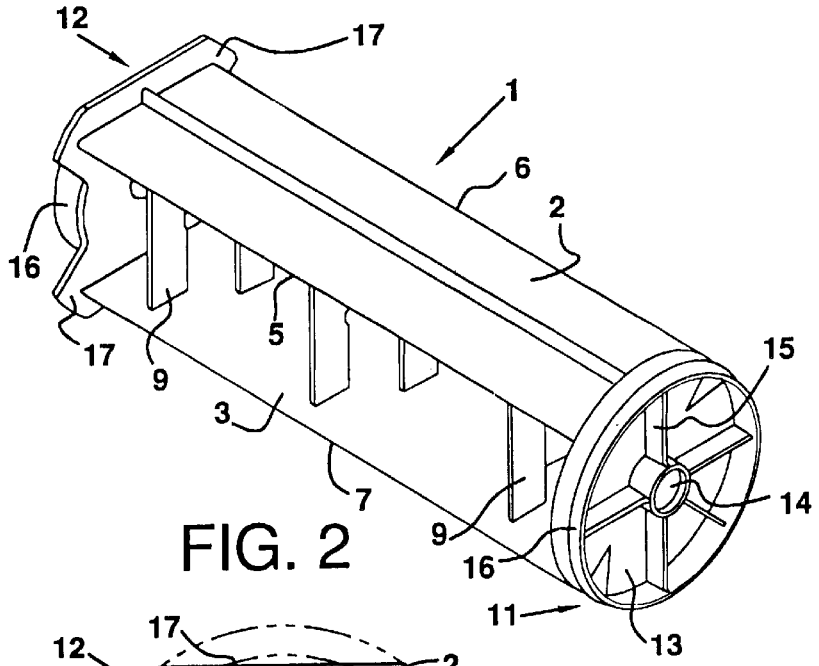
FIGS. 1 and 3 represent in perspective the rotating sleeve in a different position.

The rotating sleeve according to this invention is produced as a unit out of plastic and comprises an elongated body (1), and two end pieces (11), (12) respectively connecting to an extremity of the body (1).

Each end piece (11), (12) comprises a plate (13) with a central opening (14). Along the side of the plate (13) directed away from the body (1) radial ribs (15) are provided, and an upright cylindrical edge (16) is provided. The two end pieces (11), (12) principally differ from each other because of the fact that the plate (13) of one end piece (12) comprises two wings (17) extending sideways in opposite directions from the cylindrical edge (15), which radially widen outwards, while the plate (13) of the other end piece (11) only extends inside the cylindrical edge (16). The end pieces (11), (12) are provided in parallel planes. The diameter of the cylindrical edge (16) of end piece (11) is slightly smaller than the greatest radial transverse dimension (4).

The body (1) extends between the end pieces (11), (12), and comprises two parallel flank pieces (2), (3) produced as flat rectangular plates, which are provided opposite each other at a distance apart from each other.

These flank pieces (2), (3) extend according to a direction which is perpendicular to the planes of the end pieces (11), (12), and connect to the plates (13) of the end pieces (11), (12). The plate-shaped flank pieces (2), (3) have such a width that they extend sideways up to the edge of the plate (13) without wings. Each flank piece (2), (3) has two opposite parallel edges (5), (6), (7), (8) each of which form a side edge of the body extending according to the longitudinal direction of the body (1). As can most clearly be seen in FIG. 2, these edges (5), (6), (7), (8) determine the greatest radial transverse dimension (4) of the body (1).

The plate-shaped flank pieces (2) are connected to each other by several plate-shaped connecting pieces (9) provided between these flank pieces (2), (3), and extending according to a perpendicular transverse direction in relation to these flank pieces. The connecting pieces (9) are provided one behind the other separated from each other according to the longitudinal direction of the body. These connecting pieces (9) and the flank pieces (2), (3) are so provided in relation to each other, and have such dimensions that the body (1) at each connecting piece (9) has an I-shaped cross-section (see FIG. 2) with two perpendicular planes of symmetry. This open structure makes it possible to produce the rotating sleeve according to an injection moulding method with a simple mould. Because of this, and because of the fact that a rotating sleeve with such a form requires relatively little plastic, considerable savings can be made on the production costs.

A central slot (10) is also provided in each connecting piece (9), which forms a passage for the spindle of a holder not represented in the figures, so that this spindle can extend according to the longitudinal direction of the rotating sleeve through the openings (14) in the end pieces and the slots (10) of the successive connecting pieces (9), The rotating sleeve can because of this easily be slid on to the holder spindle, while the successive passages form several bearing points for this.

Figure 2:
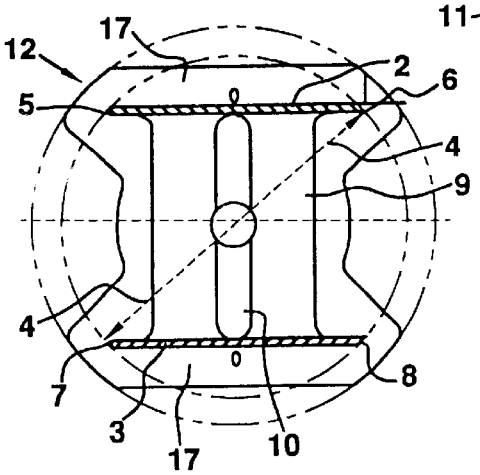
FIG. 2 represents a cross-section of the rotating sleeve.
Figure 3:
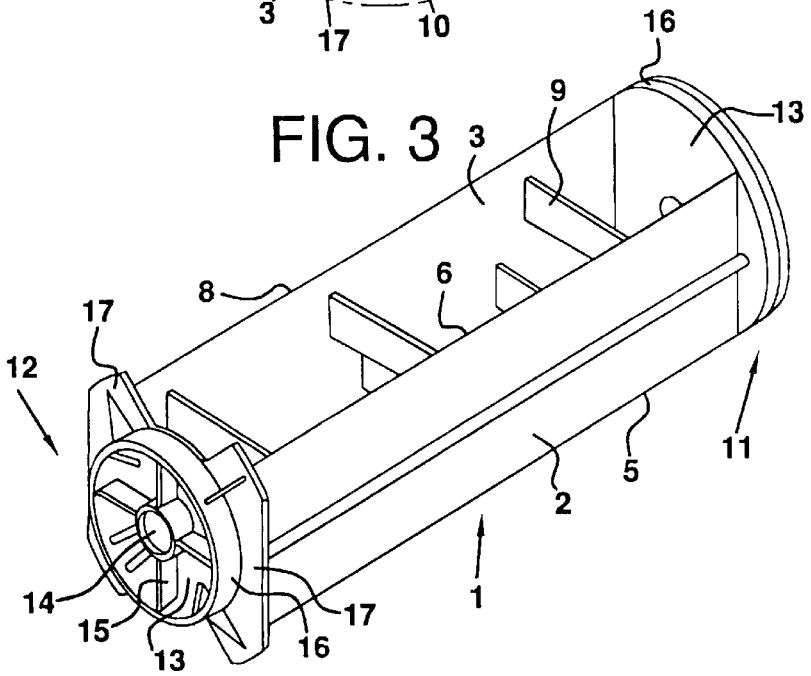

In FIG. 2 a cross-section of a cylindrical yarn sleeve slid on to the rotating sleeve is represented in dashed line. The inner walls of the yarn sleeve are against the edges (5), (6), (7), (8) of the flank pieces. The parts of the plate-shaped flank pieces (2), (3) located along the edges (5), (6), (7), (8) are produced as flexible and elastic lips. These lips can easily deform with the sliding-on of a bobbin or cross-wound spool. If a yarn sleeve has too small an internal diameter, the corresponding radial transverse dimension (4) of the body (1) will be automatically adapted to this too small a diameter through the deformation of the lips, so that the sliding-on will be able to be performed effortlessly. Through the elasticity of these lips the yarn sleeve will remain held in effective manner on the rotating sleeve.

What is claimed is:

1. A rotating sleeve of unitary structure comprising an integrally molded body, opposite end pieces integrally molded with opposing deformable flank pieces forming the integrally molded body, wherein the deformable flank pieces deform to reduce a transverse dimension of the body for receiving a yarn sleeve.

2. The rotating sleeve of claim 1, wherein the transverse dimension is a greatest radial transverse dimension of the body.

3. The rotating sleeve of claim 1, wherein the flank pieces extend along a longitudinal direction of the body.

4. The rotating sleeve of claim 3, wherein the flank pieces are plate-shaped, and at least one edge of the flank pieces is an outer side edge of the body.

5. The rotating sleeve of claim 3, wherein the flank pieces are plate-shaped and opposite edges of the flank pieces are outer side edges of the body.

6. The rotating sleeve of claim 3, wherein the flank pieces comprise at least two plate-shaped flank pieces positioned opposite and spaced apart from each other.

7. The rotating sleeve of claim 1, wherein the body is open structured between the flank pieces.

8. The rotating sleeve of claim 1, further comprising at least one connector for connecting opposite flank pieces such that the connector and the flank pieces together form an I-shaped structure.

9. The rotating sleeve of claim 1, further comprising at least two plate-shaped connectors for connecting the opposite flank pieces, each connector positioned one behind another along a longitudinal direction of the body, slots along the connectors forming a passage for a holder spindle whereby the rotating sleeve is slidably received on the holder spindle along a longitudinal direction of the body.

10. The rotating sleeve of claim 1, wherein each flank piece is plate-shaped and comprises a flexible edge forming an outer side edge of the body.

11. The rotating sleeve of claim 1, wherein each flank piece is elastically deformable.

12. The rotating sleeve of claim 1, wherein the end pieces are plate-like with central openings.

13. The rotating sleeve of claim 12, wherein the end pieces further comprise sidewalls extending away from the body, radial ribs on the sidewalls.

14. The rotating sleeve of claim 1, wherein one end-piece has a smaller diameter than the transverse radial dimension of the body.

15. The rotating sleeve of claim 14, wherein the one end-piece further comprises sidewalls extending away from the body, opposite extensions extending beyond the sidewalls, radial wings formed along outer edges of the extensions.

16. The rotating sleeve of claim 1, wherein the sleeve is of plastic material.

17. The rotating sleeve of claim 1, wherein each flank piece is plate-shaped with flexible elastic lips forming edges.

* * * * *

UNITED STATES PATENT AND TRADEMARK OFFICE

CERTIFICATE OF CORRECTION

PATENT NO : 6,119,975

DATED : September 19, 2000

INVENTOR(S) : Thierry Lemaire

It is certified that error appears in the above-identified patent and that said Letters Patent are hereby corrected as shown below:

On the title page, under item (73), "N.V. Michael Van de Wiele" should be --N.V. Michel Van de Wiele--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*